US008979490B2

(12) United States Patent
Beers et al.

(10) Patent No.: US 8,979,490 B2
(45) Date of Patent: Mar. 17, 2015

(54) FAN INLET DIFFUSER HOUSING RIVETED CENTER BODY RETENTION

(75) Inventors: Craig M. Beers, Wethersfield, CT (US); Seth E. Rosen, Middletown, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 595 days.

(21) Appl. No.: 13/248,886

(22) Filed: Sep. 29, 2011

(65) Prior Publication Data

US 2013/0084176 A1 Apr. 4, 2013

(51) Int. Cl.
*F04D 29/54* (2006.01)
*F04D 29/66* (2006.01)

(52) U.S. Cl.
CPC ..... *F04D 29/545* (2013.01); *F04D 29/664* (2013.01)
USPC ..... 415/209.4; 415/137; 415/215.1

(58) Field of Classification Search
USPC ..... 415/134, 137, 209.3, 209.4, 210.1, 415/215.1, 207, 119
See application file for complete search history.

(56) References Cited

U.S. PATENT DOCUMENTS

| | | | | | |
|---|---|---|---|---|---|
| 2,648,353 | A | * | 8/1953 | Haworth | 138/37 |
| 4,209,993 | A | | 7/1980 | Rannenberg | |
| 4,374,469 | A | | 2/1983 | Rannenberg | |
| 4,430,867 | A | | 2/1984 | Warner | |
| 4,453,887 | A | * | 6/1984 | Schucker | 415/119 |
| 4,475,867 | A | * | 10/1984 | Smith | 415/119 |
| 4,828,175 | A | * | 5/1989 | Heufler et al. | 239/142 |
| 4,993,918 | A | * | 2/1991 | Myers et al. | 415/191 |
| 5,014,518 | A | | 5/1991 | Thomson et al. | |
| 5,060,471 | A | * | 10/1991 | Torkelson | 60/262 |
| 5,133,194 | A | | 7/1992 | Army, Jr. et al. | |
| 5,272,869 | A | * | 12/1993 | Dawson et al. | 60/796 |
| 5,312,227 | A | * | 5/1994 | Grateau et al. | 415/209.3 |
| 5,880,378 | A | * | 3/1999 | Behring, II | 73/861.53 |
| 5,894,721 | A | * | 4/1999 | Hanson | 60/226.1 |
| 6,409,472 | B1 | * | 6/2002 | McMahon et al. | 415/189 |
| 7,029,234 | B2 | * | 4/2006 | Jensen | 415/207 |
| 2005/0241149 | A1 | * | 11/2005 | Lundgren et al. | 29/889.22 |
| 2007/0256889 | A1 | * | 11/2007 | Yu et al. | 181/214 |

FOREIGN PATENT DOCUMENTS

| | | |
|---|---|---|
| CN | 101541635 | 9/2009 |

OTHER PUBLICATIONS

China Patent Application No. 201210460507.6 First Office Action dated Sep. 23, 2014, 14 pages.

* cited by examiner

*Primary Examiner* — Nathaniel Wiehe
*Assistant Examiner* — Wayne A Lambert
(74) *Attorney, Agent, or Firm* — Cantor Colburn LLP

(57) ABSTRACT

A fan inlet diffuser housing system includes an air cycle machine, a housing coupled to the air cycle machine, an inlet fan disposed on the air cycle machine and configured to pass inlet air into the fan inlet diffuser housing, a center tube disposed in the housing, a diffuser cone disposed around the center tube, an inboard strut supporting the inner tube within the diffuser cone, and an outboard strut supporting the inner tube within the diffuser cone, the outboard strut being integral with the diffuser cone, wherein the inboard strut is coupled to the inner tube with a first plurality of mechanical fasteners, and the outboard strut is coupled to the inner tube with a second plurality of mechanical fasteners.

17 Claims, 6 Drawing Sheets

FAN INLET DIFFUSER HOUSING RIVETED CENTER BODY RETENTION

BACKGROUND OF THE INVENTION

The present invention relates to fan inlet diffuser housings for air cycle machines, and more specifically, to systems and methods for retaining a center body in a fan inlet diffuser housing by mechanical fasteners.

In modern commercial aircraft, an air cycle machine (ACM) is provided to suitably condition air to be supplied to the cabin or cockpit or other locations for occupant comfort. Typically, such ACMs condition a flow of pressurized air, for example bleed air from the aircraft engine, by not only regulating the pressure of the air to a desired level for cabin pressurization, but also by cooling and dehumidifying the air. The flow of compressed bleed air to be conditioned, which can be in excess of 150° C., is first passed through a compressor section of the ACM where it is further cooled causing condensation of moisture in the air, thereby dehumidifying the air. The dehumidified air is then expanded through a turbine section of the ACM to reduce the pressure to a desired pressure level for delivery to its point of use, (e.g. the aircraft passenger or pilot cabin). ACMs include Fan Inlet Diffuser Housings (FIDHs) to receive the flow of the hot intake air. In order to reduce noise in the FIDH, components of the FIDH are in a bonded configuration. In the presence of the heated air, the bonds can release.

BRIEF DESCRIPTION OF THE INVENTION

Exemplary embodiments include a fan inlet diffuser housing system, including an air cycle machine, a housing coupled to the air cycle machine, an inlet fan disposed on the air cycle machine and configured to pass inlet air into the fan inlet diffuser housing, a center tube disposed in the housing, a diffuser cone disposed around the center tube, an inboard strut supporting the inner tube within the diffuser cone, and an outboard strut supporting the inner tube within the diffuser cone, the outboard strut being integral with the diffuser cone, wherein the inboard strut is coupled to the inner tube with a first plurality of mechanical fasteners, and the outboard strut is coupled to the inner tube with a second plurality of mechanical fasteners.

Additional exemplary embodiments include a fan inlet diffuser housing apparatus, including a housing, a center tube disposed in the housing, a diffuser cone disposed around the center tube, an inboard strut supporting the inner tube within the diffuser cone, and an outboard strut supporting the inner tube within the diffuser cone, the outboard strut being integral with the diffuser cone, wherein the inboard strut is coupled to the inner tube with a first plurality of mechanical fasteners, and the outboard strut is coupled to the inner tube with a second plurality of mechanical fasteners.

Further exemplary embodiments include a method for supporting an inner tube in a diffuser cone of a fan inlet diffuser housing, the method including mechanically fastening three outer diameter walls of an inboard strut to the diffuser cone and the inner tube, mechanically fastening three inner diameter walls of the inboard strut to the inner tube and mechanically fastening three inner diameter walls of an outboard strut to the inner tube, the outboard strut being integral with the diffuser cone.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
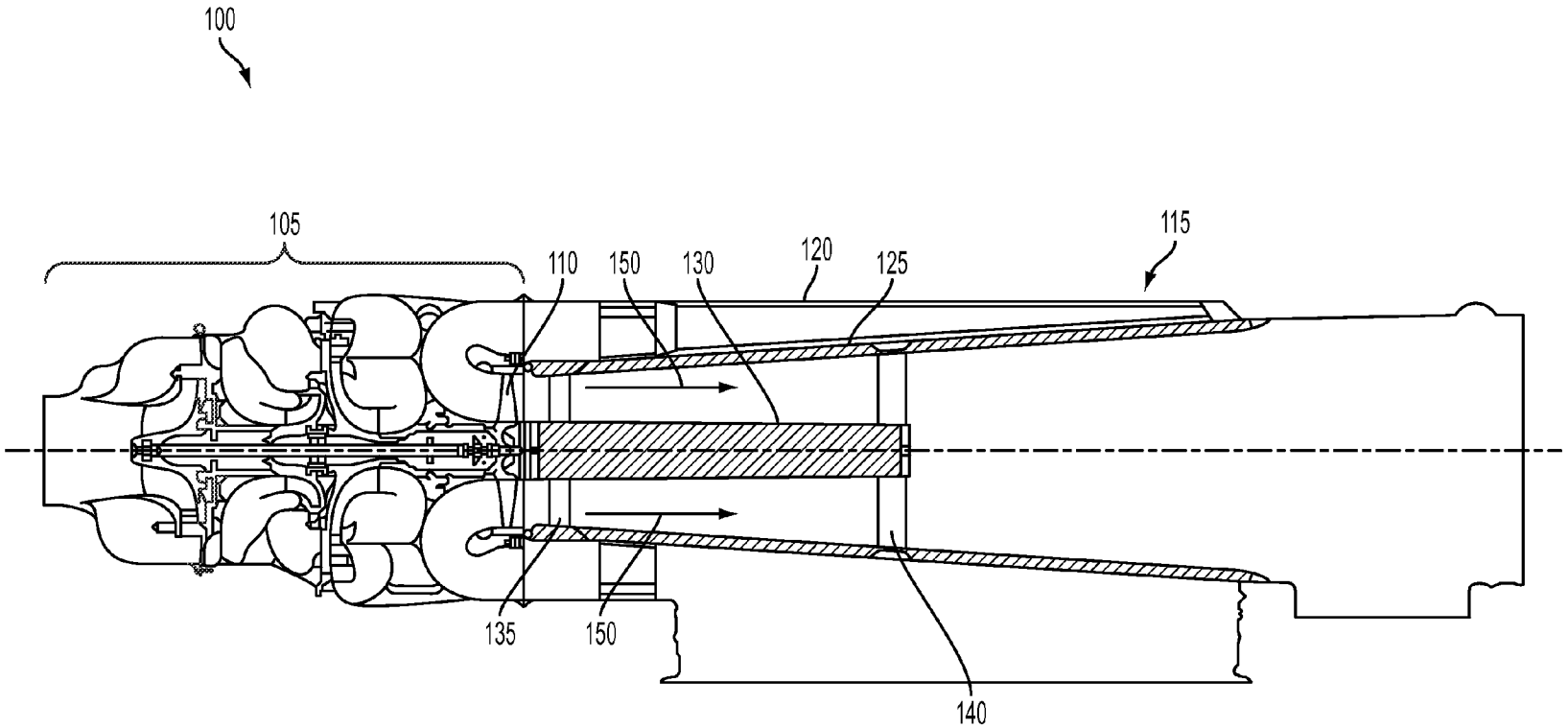
FIG. 1 illustrates a fan inlet diffuser housing system in accordance with one embodiment.

FIG. 1 illustrates a FIDH system 100 in accordance with one embodiment. The FIDH system 100 includes an ACM 105 coupled to a FIDH 115. The system 100 further includes an inlet fan 110 that passes the inlet air into the FIDH 115. Airflow is represented by arrow 150. The FIDH 115 includes a housing 120, a diffuser cone 125 disposed within the housing 120 and a center tube (center body) 130 disposed within the diffuser cone 125. The center tube 130 is disposed within the diffuser cone 125 via an inboard strut 135 and an outboard inboard strut 140.

Figure 2:
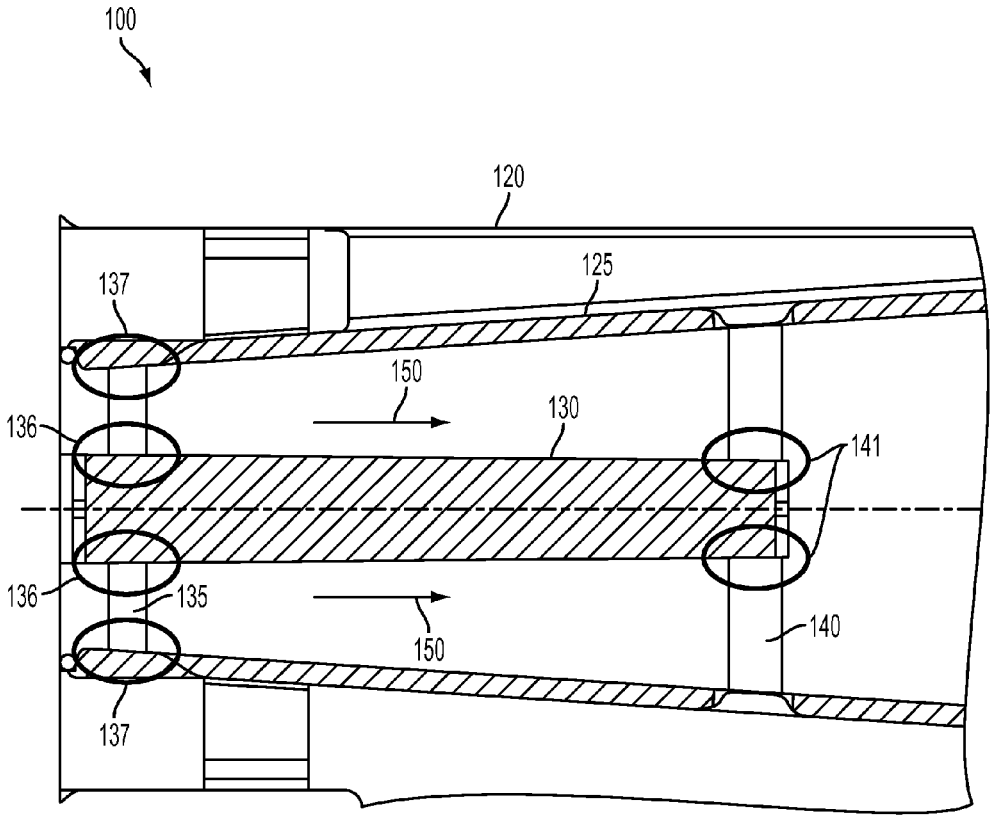
FIG. 2 illustrates further details of the fan inlet diffuser housing of FIG. 1.

FIG. 2 illustrates further details of the housing 120, the diffuser cone 125, the center tube 130, the inboard strut 135 and outboard strut 140 of FIG. 1. As described further herein, the center tube 130 is mechanically fastened to the inboard and outboard struts 135, 140 via mechanical fasteners such as rivets at locations 136, 141, respectively. In addition, the inboard strut 135 is mechanically fastened to the diffuser cone 125 via mechanical fasteners, such as rivets at location 137. In the illustrated embodiment, the outboard strut 140 is integrally coupled to the diffuser cone 125. In another embodiment, the outboard strut 140 can be mechanically fastened to the diffuser cone 125 via mechanical fasteners, such as rivets. As described herein, conventional methods to connect similar struts to similar diffuser cones, and similar center tubes to similar struts include material binding that can fail under the heated air.

Figure 3:
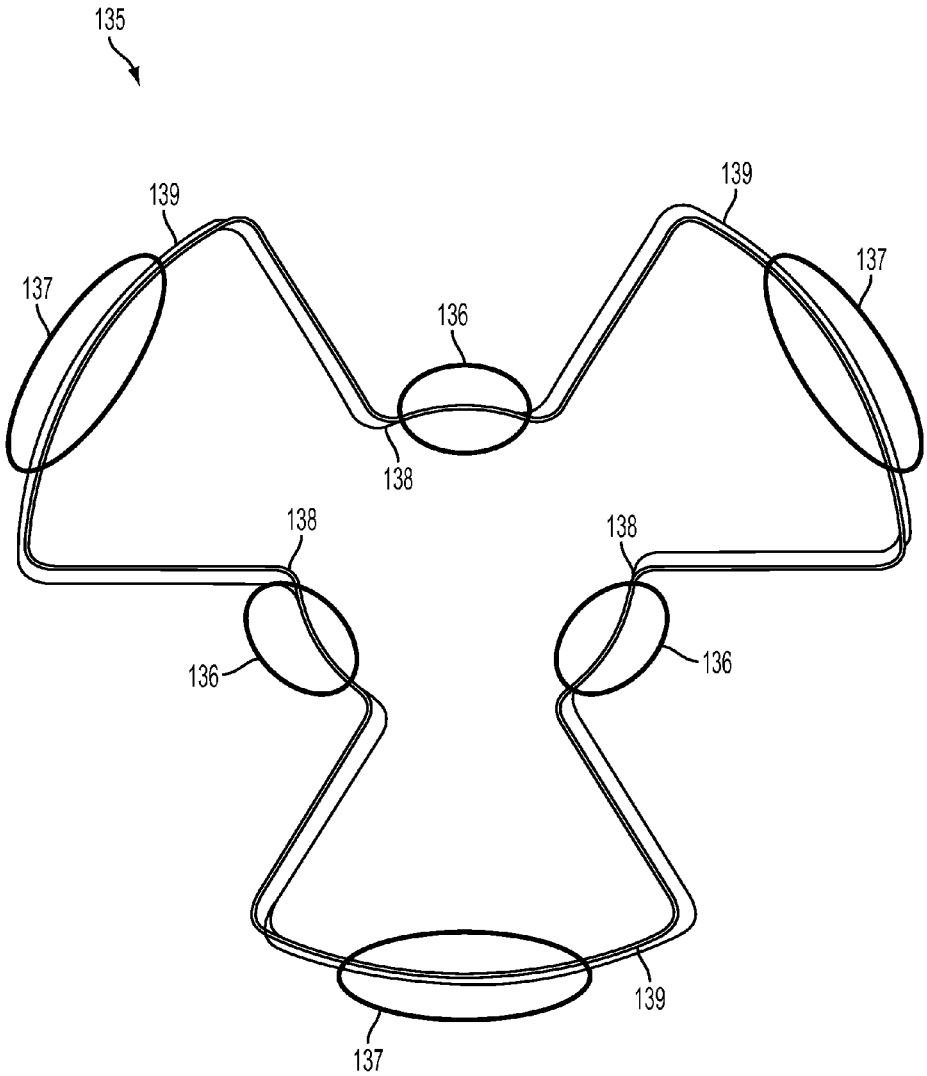
FIG. 3 is a front view of an inboard strut of FIGS. 1 and 2.
Figure 4:
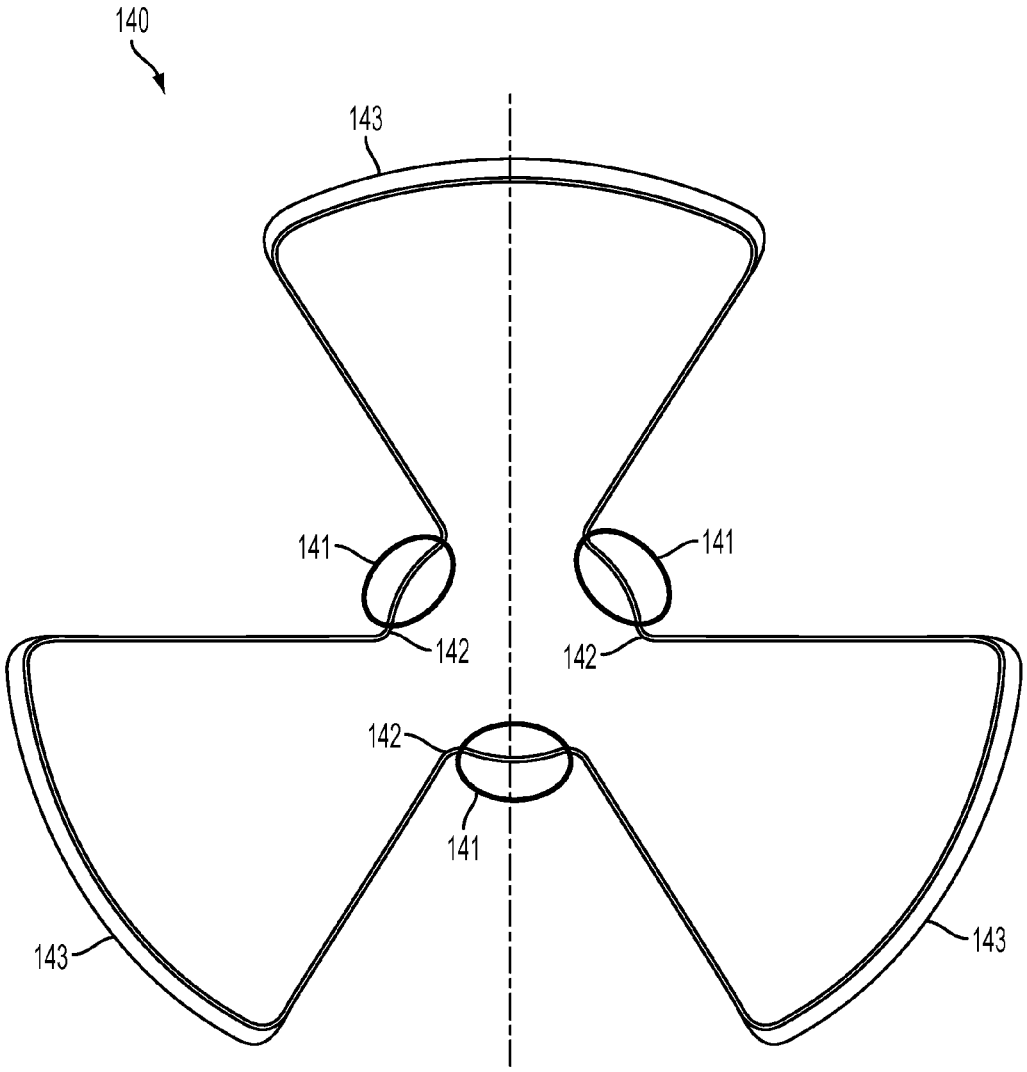
FIG. 4 is a front view of an outboard strut of FIGS. 1 and 2.

FIG. 3 illustrates a front view of the inboard strut 135 of FIGS. 1 and 2. FIG. 4 illustrates a front view of the outboard strut 140 of FIGS. 1 and 2. The locations 136, 141 in which the inboard strut 135 and the outboard strut 140, respectively, are coupled to the inner tube 130 are illustrated further in FIG. 5. The location 137 in which the inboard strut 135 is coupled to the diffuser cone 125 are illustrated further in FIG. 6. As best seen in FIGS. 3 and 4, the inboard and outboard struts 135, 140 each have an inner diameter wall 138, 142 and an outer diameter wall 139, 143, respectively. As such, it can be appreciated that the inner diameter walls 138, 142 at the locations 136, 141 are mechanically fastened to the inner tube 130. It can further be appreciated that the outer diameter walls 139 at the location 137 is mechanically fastened to the diffuser cone 125.

Figure 5:
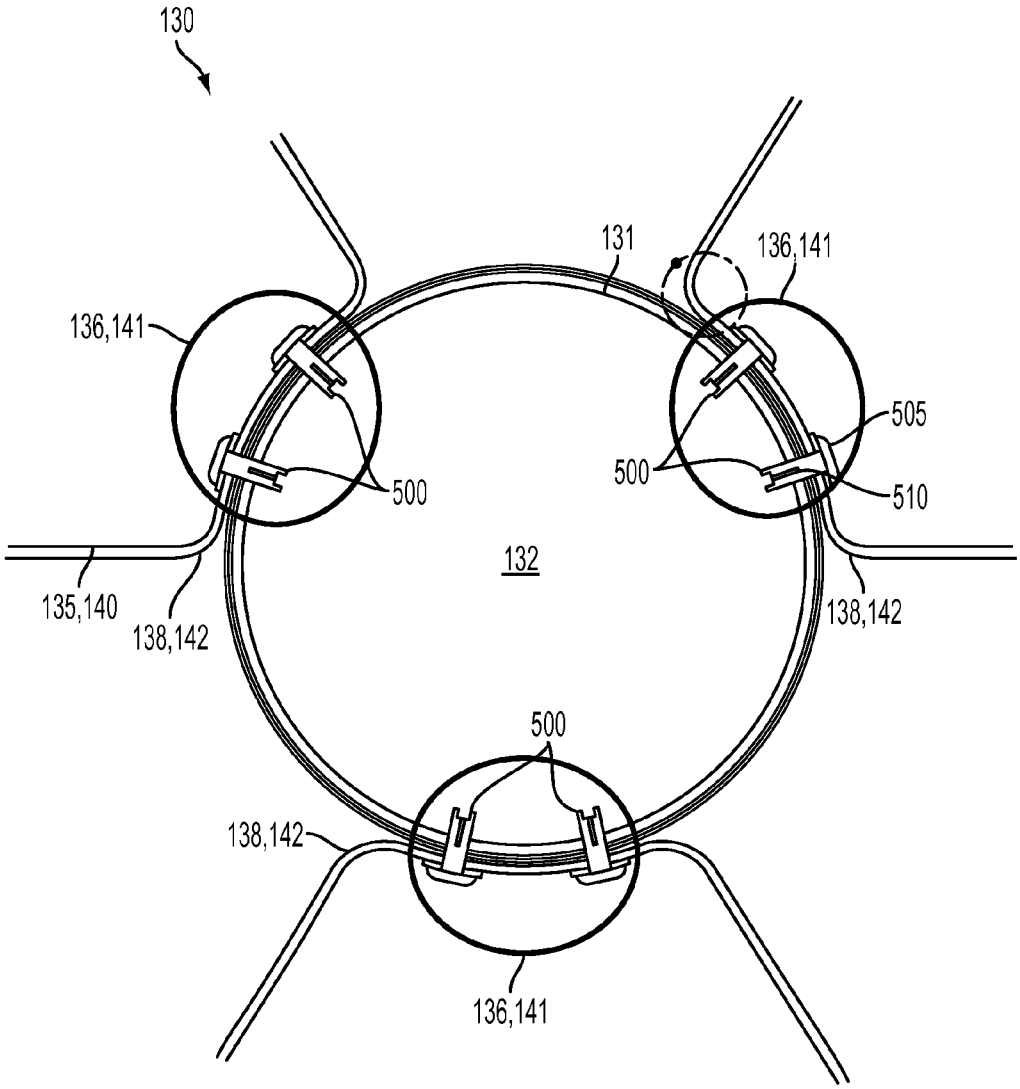
FIG. 5 is a cross-section of a center tube of a diffuser section that illustrates mechanical fastener locations of inboard/outboard struts thereto.

Referring to FIG. 5, details of the locations 136, 141 where the inboard and outboard struts 135, 140 are coupled to the inner tube 130 are now described. In one embodiment, the inner diameter walls 138, 142 are mechanically fastened to an outer surface 131 of the inner tube 130 by mechanical fasteners 500. In one embodiment, the mechanical fasteners 500 are rivets having a head 505 and shaft 510. In one example, the rivet can be a flush rivet in which the head 505 is flush with the inner diameter walls 138,142 of the inboard and outboard struts 135, 140. When the rivets are inserted into the inner tube 130, the shaft 510 becomes upset during installation as known when rivets are installed. It can be appreciated that the upset shaft 510 is not present in the airflow around the inner tube 130. In one embodiment, the inner tube 130 can include acoustical foam 132 disposed therein to reduce any acoustical noise of the airflow across the mechanical fasteners 500. As such, in one embodiment, the orientation of the mechanical fasteners 500 with the upset end of the mechanical fastener 500 facing out of the airflow into the acoustical foam 132 thereby provides a secure coupling between the inboard and outboard struts 135, 140 and the inner tube 130. Furthermore, at least two mechanical fasteners 500 are implemented at each of the respective locations 136, 141 in order to be spaced evenly along the inner diameter walls 138, 142. The total number of mechanical fasteners 500 for each of the inboard and outboard struts 135, 140 at the locations 136, 141 is six. Of course, in other embodiments, the number and locations of the rivets could be varied.

Figure 6:
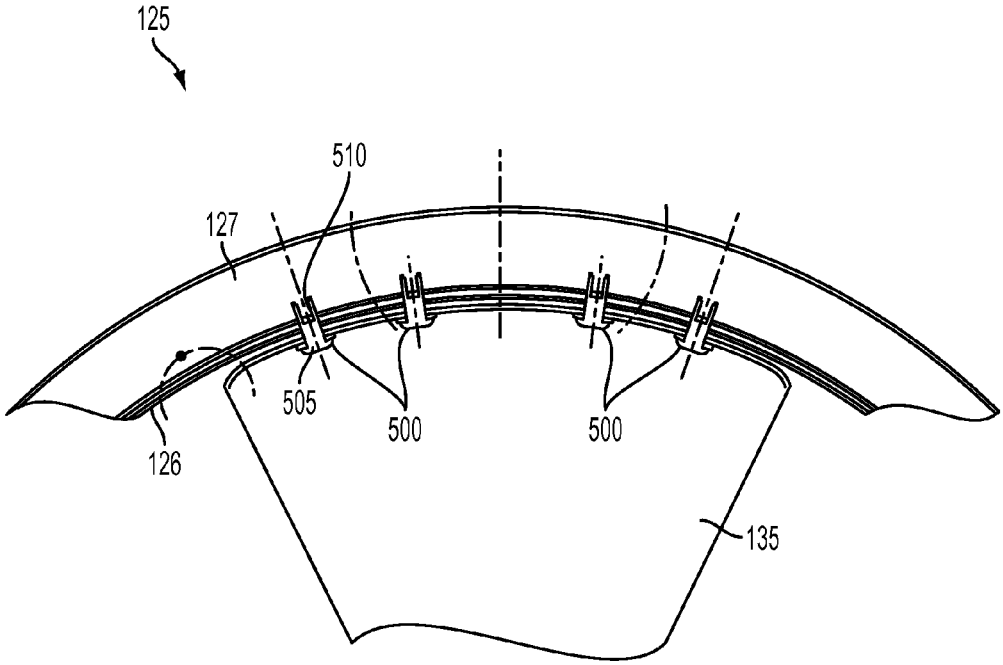
FIG. 6 is a partial cross-section of a diffuser cone that illustrates mechanical fastener locations between the diffuser cone and an inboard strut.

Referring to FIG. 6, details of the location 137 where the inboard strut 135 is coupled to the diffuser cone 125 are now described. In one embodiment, the outer diameter walls 139 are mechanically fastened to an inner surface 126 of the diffuser cone 125 by mechanical fasteners 500. In one embodiment, the mechanical fasteners 500 are rivets having a head 505 and shaft 510. In one example, the rivet can be a flush rivet in which the head 505 is flush with the outer diameter walls 139 of the inboard strut 135. When the rivets are inserted into the diffuser cone 125, the shaft 510 becomes upset during installation as known when rivets are installed. It can be appreciated that the upset shaft 510 is not present in the airflow adjacent the inner surface 126 of the diffuser cone 125. In one embodiment, the diffuser cone 125 can include acoustical foam 127 therein to reduce any acoustical noise of the airflow across the mechanical fasteners 500. As such, in one embodiment, the orientation of the mechanical fasteners 500 with the upset end of the mechanical fastener 500 facing out of the airflow into the acoustical foam thereby provides a secure coupling between the inboard strut 135 and the diffuser cone 125. Furthermore, at least four mechanical fasteners 500 are implemented at each of the respective locations 137 in order to be spaced evenly along the outer diameter walls 139. The total number of mechanical fasteners 500 for the inboard strut at the location 137 is twelve. Of course, the number and spacing of the mechanical fasteners 500 could be varied as needed.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fan inlet diffuser housing (FIDH) system, comprising:

an air cycle machine (ACM);

an FIDH housing coupled to the ACM;

an inlet fan disposed on the ACM and configured to pass inlet air into the FIDH;

a center tube disposed in the FIDH housing, wherein the center tube further comprises acoustical foam disposed therein;

a diffuser cone disposed around at least a portion of the center tube;

an inboard strut supporting the center tube within the diffuser cone, the inboard strut having a substantially Y-shaped cross-section and comprising three outer diameter walls and three inner diameter walls; and an outboard strut supporting the center tube within the diffuser cone, the outboard strut being integral with the diffuser cone, the outboard strut having a substantially Y-shaped cross-section and comprising three outer diameter walls and three inner diameter walls, wherein the three inner diameter walls of the inboard strut are coupled to the center tube with a first plurality of mechanical fasteners, the three inner diameter walls of the outboard strut are coupled to the center tube with a second plurality of mechanical fasteners, the three outer diameter walls of the inboard strut are coupled to the diffuser cone with a third plurality of mechanical fasteners, upset ends of the first and second plurality of mechanical fasteners are disposed in the acoustical foam, and the first plurality of mechanical fasteners comprises six rivets distributed in pairs at each of the three inner diameter walls of the inboard strut.

2. The system as claimed in claim 1 wherein the second plurality of mechanical fasteners comprises six rivets distributed in pairs at each of the three inner diameter walls of the outboard strut.

3. The system as claimed in claim 2 wherein the third plurality of mechanical fasteners comprises twelve rivets distributed in groups of four at each of the three outer diameter walls of the inboard strut.

4. The system as claimed in claim 1 wherein the diffuser cone further comprises acoustical foam.

5. The system as claimed in claim 4 wherein upset ends of the third plurality of mechanical fasteners are disposed in the acoustical foam of the diffuser cone.

6. The system as claimed in claim 1 wherein each location of coupling each of the inner diameter walls of the inboard strut to the center tube is on a distal side of the center tube relative to one of the outer diameter walls of the inboard strut aligned with the location on an opposite side of the center tube.

7. The system as claimed in claim 1 wherein the inner diameter walls and the outer diameter walls of the inboard strut are arranged in an alternating pattern circumferentially about the inboard strut.

8. A fan inlet diffuser housing (FIDH) apparatus, comprising:

a housing;

a center tube disposed in the housing, wherein the center tube further comprises acoustical foam disposed therein;

a diffuser cone disposed around at least a portion of the center tube;

an inboard strut supporting the center tube within the diffuser cone, the inboard strut having a substantially Y-shaped cross-section and comprising three outer diameter walls and three inner diameter walls; and an outboard strut supporting the center tube within the diffuser cone, the outboard strut being integral with the diffuser cone, the outboard strut having a substantially Y-shaped cross-section and comprising three outer diameter walls and three inner diameter walls, wherein the three inner diameter walls of the inboard strut are coupled to the center tube with a first plurality of mechanical fasteners, and the three inner diameter walls of the outboard strut are coupled to the center tube with a second plurality of mechanical fasteners, the three outer diameter walls of the inboard strut are coupled to the diffuser cone with a third plurality of mechanical fasteners, upset ends of the first and second plurality of mechanical fasteners are disposed in the acoustical foam, and the first plurality of mechanical fasteners comprises six rivets distributed in pairs at each of the three inner diameter walls of the inboard strut.

9. The apparatus as claimed in claim 8 wherein the second plurality of mechanical fasteners comprises six rivets distributed in pairs at each of the three inner diameter walls of the outboard strut.

10. The apparatus as claimed in claim 9 wherein the third plurality of mechanical fasteners comprises twelve rivets distributed in groups of four at each of the three outer diameter walls of the inboard strut.

11. The apparatus as claimed in claim 8 wherein the diffuser cone further comprises acoustical foam.

12. The apparatus as claimed in claim 11 wherein upset ends of the third plurality of mechanical fasteners are disposed in the acoustical foam of the diffuser cone.

13. The apparatus as claimed in claim 8 wherein each location of coupling each of the inner diameter walls of the inboard strut to the center tube is on a distal side of the center tube relative to one of the outer diameter walls of the inboard strut aligned with the location on an opposite side of the center tube.

14. The apparatus as claimed in claim 8 wherein the inner diameter walls and the outer diameter walls of the inboard strut are arranged in an alternating pattern circumferentially about the inboard strut.

15. A method for supporting a center tube in a diffuser cone of a fan inlet diffuser housing (FIDH), the method comprising:

mechanically fastening three outer diameter walls of an inboard strut having a substantially Y-shaped cross-section to the diffuser cone;

mechanically fastening three inner diameter walls of the inboard strut to the center tube, wherein the center tube further comprises acoustical foam disposed therein; and mechanically fastening three inner diameter walls of an outboard strut having a substantially Y-shaped cross-section to the center tube, the outboard strut being integral with the diffuser cone, wherein the three inner diameter walls of the inboard strut are mechanically fastened to the center tube with a first plurality of mechanical fasteners, the three inner diameter walls of the outboard strut are mechanically fastened to the center tube with a second plurality of mechanical fasteners, the three outer diameter walls of the inboard strut are mechanically fastened to the diffuser cone with a third plurality of mechanical fasteners, upset ends of the first and second plurality of mechanical fasteners are disposed in the acoustical foam, and the inner diameter walls and the outer diameter walls of the inboard strut are arranged in an alternating pattern circumferentially about the inboard strut.

16. The method as claimed in claim 15 wherein the three outer diameter walls of the inboard strut are mechanically fastened to the diffuser cone by twelve rivets distributed in groups of four at each of the three outer diameter walls of the inboard strut, the three inner diameter walls of the inboard strut are mechanically fastened to the center tube by six rivets distributed in pairs at each of the three inner diameter walls of the inboard strut, and the three inner diameter walls of the outboard strut are mechanically fastened to the center tube by six rivets distributed in pairs at each of the three inner diameter walls of the outboard strut.

17. The method as claimed in claim 15 wherein each location of mechanically fastening each of the inner diameter walls of the inboard strut to the center tube is on a distal side of the center tube relative to one of the outer diameter walls of the inboard strut aligned with the location on an opposite side of the center tube.

* * * * *